US007648446B2

(12) United States Patent
Chiles et al.

(10) Patent No.: US 7,648,446 B2
(45) Date of Patent: Jan. 19, 2010

(54) SYSTEM AND METHOD FOR ELECTRONICALLY CONTROLLING RESISTANCE OF AN EXERCISE MACHINE

(75) Inventors: Mark W. Chiles, Yorba Linda, CA (US); Kevin P. Corbalis, Tustin, CA (US); Gregory Allen Wallace, Mission Viejo, CA (US)

(73) Assignee: Unisen, Inc., Irvine, CA (US)

( * ) Notice: Subject to any disclaimer, the term of this patent is extended or adjusted under 35 U.S.C. 154(b) by 773 days.

(21) Appl. No.: 11/148,008

(22) Filed: Jun. 8, 2005

(65) Prior Publication Data

US 2006/0003872 A1 Jan. 5, 2006

Related U.S. Application Data

(60) Provisional application No. 60/578,345, filed on Jun. 9, 2004, provisional application No. 60/621,844, filed on Oct. 25, 2004.

(51) Int. Cl.
*A63B 22/06* (2006.01)

(52) U.S. Cl. ..... 482/57; 482/5

(58) Field of Classification Search ..... 482/1, 482/2, 3, 4, 5, 6, 7, 8, 9, 57, 63, 64, 900; 434/61

See application file for complete search history.

(56) References Cited

U.S. PATENT DOCUMENTS

| | | | | | |
|---|---|---|---|---|---|
| 3,589,193 | A | | 6/1971 | Thornton | |
| 3,767,195 | A | | 10/1973 | Dimick | |
| 3,903,613 | A | * | 9/1975 | Bisberg | 434/61 |
| 4,602,373 | A | | 7/1986 | Dorfman | |
| 4,709,917 | A | | 12/1987 | Yang | |
| 4,789,153 | A | * | 12/1988 | Brown | 482/111 |
| 4,842,274 | A | * | 6/1989 | Oosthuizen et al. | 482/5 |
| 4,938,474 | A | * | 7/1990 | Sweeney et al. | 482/52 |
| 4,938,475 | A | * | 7/1990 | Sargeant et al. | 482/9 |
| 5,067,710 | A | * | 11/1991 | Watterson et al. | 482/3 |
| 5,240,417 | A | * | 8/1993 | Smithson et al. | 434/61 |
| 5,256,115 | A | | 10/1993 | Scholder et al. | |
| 5,762,584 | A | | 6/1998 | Daniels | |
| 5,890,995 | A | * | 4/1999 | Bobick et al. | 482/4 |
| 6,152,856 | A | * | 11/2000 | Studor et al. | 482/8 |
| 6,749,537 | B1 | | 6/2004 | Hickman | |
| 2003/1004540 | | | 3/2003 | Watterson et el. | |
| 2006/0046905 | A1 | | 3/2006 | Doody, Jr. et al. | |
| 2007/0281828 | A1 | * | 12/2007 | Rice | 482/4 |

* cited by examiner

*Primary Examiner*—Loan H Thanh
*Assistant Examiner*—Tam Nguyen
(74) *Attorney, Agent, or Firm*—Knobbe, Martens, Olson and Bear, LLP

(57) ABSTRACT

A stationary exercise machine includes a system for electronically controlling a pedal resistance so as to simulate the riding of a road-going bicycle. The exercise machine includes a control system that monitors pedal velocity and that controls the resistive load generated by an electronically-controlled resistance mechanism. In one example, an electromagnetic device may vary a resistive load placed on a flywheel, which, in turn, varies the pedal resistance experienced by a user. When the user increases the pedal velocity, the resistance mechanism increases the resistive load. When the user decreases the pedal velocity, the resistance mechanism decreases the resistive load. In another example, the resistance mechanism varies the resistive load based on a gear selection by the user. The control system may also take into account other factors, such as the grade of the simulated ride, simulated wind resistance, or other frictional forces when calculating the resistive load.

18 Claims, 8 Drawing Sheets

SYSTEM AND METHOD FOR ELECTRONICALLY CONTROLLING RESISTANCE OF AN EXERCISE MACHINE

RELATED APPLICATIONS

This application claims the benefit of priority under 35 U.S.C. § 119(e) of U.S. Provisional Patent Application No. 60/578,345 filed on Jun. 9, 2004, entitled "SYSTEM AND METHOD FOR ELECTRONICALLY CONTROLLING RESISTANCE OF STATIONARY EXERCISE MACHINE," and U.S. Provisional Patent Application No. 60/621,844 filed on Oct. 25, 2004, entitled "SYSTEM AND METHOD FOR ELECTRONICALLY CONTROLLING RESISTANCE OF AN EXERCISE MACHINE," each of which is hereby incorporated herein by reference in its entirety.

BACKGROUND OF THE INVENTION

1. Field of the Invention

The present disclosure relates to an exercise machine having an electronically-controlled resistance and, in particular, a system and method for controlling the pedal resistance of a stationary exercise bicycle.

2. Description of the Related Art

The benefits of regular exercise to improve overall health, fitness and longevity are well documented in the literature. Medical science has consistently demonstrated the improved strength, health and enjoyment of life that results from physical activity. Exercises, such as cycling, are particularly popular and medically recommended exercises for conditioning training and improving overall health and cardiovascular efficiency.

However, modern lifestyles often fail to accommodate outdoor cycling opportunities. In addition, inclimate weather and other environmental and social factors may cause individuals to remain indoors as opposed to engaging in outdoor cycling activities. There are also certain dangers and/or health risks associated with cycling on natural outdoor surfaces. For example, injuries may result from cycling, particularly from falls and/or accidents, not to mention the risk of physical harm from the failure of the bicycle itself. Thus, many exercise enthusiasts prefer the safety and convenience of an in-home or commercial exercise machine in order to provide desired exercise without the attendant inconvenience and risk of outdoor exercise.

Conventional indoor stationary bicycles generally operate with a single-gear drivetrain allowing a user to select the resistance felt while pedaling. For example, in some stationary bicycles having an electronically-controlled resistance, users are able to select a certain workout level or routine that is associated with a predetermined pattern of changes in pedal resistance. In addition, other stationary bicycles are configured to provide the user with a constant wattage workout. A constant wattage system operates so as to produce a constant power, which is often measured by the revolutions per minute (RPM) at which the user is cycling multiplied by the torque exerted by the user on the cranks.

SUMMARY OF THE INVENTION

However, even in light of the foregoing, traditional stationary bicycles having predetermined resistance levels or operating in a constant wattage do not accurately simulate the momentum and gear-shifting properties that a user generally encounters when riding a road-going bicycle. Accordingly, what is needed is a stationary bicycle that electronically controls the pedal resistance felt by the user so as to better simulate riding a road-going bicycle. More specifically, a need exists for a stationary bicycle that can simulate one or more momentum and/or gear-shifting properties, or the like, generally experienced by riders of road-going bicycles.

For example, in an embodiment, a stationary bicycle provides the user with a gear selector device usable to shift between different simulated gears. When shifting from a lower gear to a higher gear on a road-going bicycle, a user generally experiences an increase in pedal resistance due to a change in the ratio of the bicycle crank arm revolutions to the revolutions of the bicycle wheel. Likewise, if the user of the stationary bicycle "shifts" to a higher gear, the stationary bicycle increases the pedal resistance. If the user selects a lower gear, the stationary bicycle decreases the pedal resistance.

In one embodiment, the foregoing is accomplished on a single-gear stationary bicycle including an electronic control system usable to simulate changes in pedal resistance experienced when shifting gears on a road-going bicycle. For example, in response to a particular gear selection, the electronic control system may adjust a resistive load on a flywheel, which, in turn, affects the pedal resistance of the stationary bicycle. For instance, if the user of the stationary bicycle chooses to simulate riding in a higher gear, the control system increases the flywheel resistive load, which increases the pedal resistance felt by the user.

In a further embodiment, a control system varies the pedal resistance of a stationary bicycle to simulate, at least in part, the momentum properties that a user generally experiences while riding a road-going bicycle. For example, when attempting to increase the linear momentum of a road-going bicycle by pedaling faster, the user generally experiences an increased pedal resistance. Likewise, when the user attempts to slow down his or her pedal speed, such as while "coasting," the user experiences a decreased pedal resistance. In one embodiment of the invention, the control system electronically controls a pedal resistance based on acceleration or deceleration of the user's pedal rotation. For example, the control system may adjust the resistive load on a bicycle flywheel based on changes in the angular velocity (i.e., rotational velocity) of the flywheel.

In yet other embodiments of the invention, a control system adjusts the pedal resistance of a stationary bicycle to closer simulate other resistance affecting factors that a user generally encounters on a road-going bicycle. For example, a processor may calculate a resistive load based on simulation variables representing changes in pedal resistance due to parasitic factors, such as wind resistance and tire friction, or the grade (i.e., incline or decline) of the ride.

In another embodiment, the control system varies the resistive load and the angular momentum of a flywheel to simulate the gear-shifting and momentum properties of a road-going bicycle. For example, the control system may use an electromagnet to vary the flywheel resistive load and, thus, the pedal resistance. In one embodiment, a processor causes adjustments to the flywheel resistive load based in part on changes in the angular velocity of the flywheel, which changes correspond to acceleration and/or deceleration in the pedal rotation.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE PREFERRED EMBODIMENTS

Figure 1:
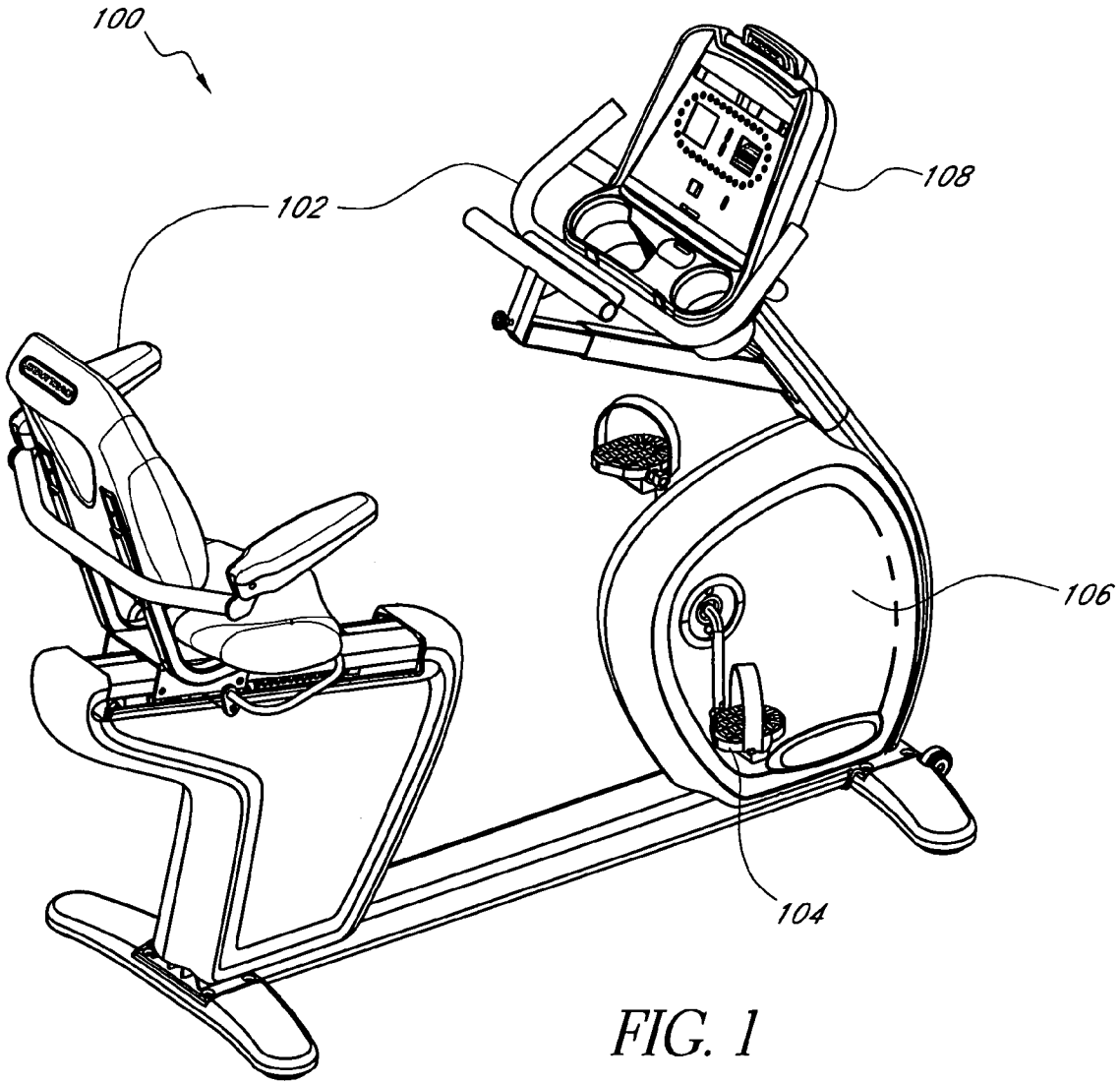
FIG. 1 illustrates a perspective view of a recumbent exercise bicycle according to one embodiment of the invention.

Traditional stationary bicycles having predetermined resistance levels or operating in a constant wattage do not accurately simulate the momentum and/or gear-shifting properties that a user generally encounters when riding a road-going bicycle. Accordingly, what is needed is a stationary bicycle that electronically controls the pedal resistance felt by the user so as to better simulate riding a road-going bicycle, including, but not limited to, momentum or gear-shifting properties, or the like.

"Pedal resistance" as used hereinafter is a broad term and is used in its ordinary sense and includes without limitation the resistance or opposing force felt by the user while operating the pedals of a bicycle. As the pedal resistance increases, the more difficult it becomes to pedal the bicycle (i.e., requires a greater torque or force to rotate the pedals). The term "simulation pedal resistance" is used hereinafter to describe the pedal resistance of a stationary bicycle. Such simulation pedal resistance is advantageously controlled to better simulate or represent the pedal resistance of a road-going bicycle under certain cycling conditions.

In general, the pedal resistance of a road-going bicycle is related to several cycling conditions, including for example: (1) the grade (i.e., incline or decline) and characteristics of the ground surface; (2) the gear in which the user is cycling; (3) the combined linear momentum of the bicycle and the user; (4) acceleration or deceleration of the pedal rotation; (5) the velocity of the bicycle; and (6) parasitic factors, such as wind resistance, wheel turbulence, and tire friction. Simulation of one or more of these cycling conditions on a stationary bicycle advantageously increases the likeness of the simulation to the road-going cycling experience.

As mentioned, the pedal resistance of a road-going bicycle is affected by which gear is selected. In general, the gear selection determines the ratio of crank arm revolutions to revolutions of the bicycle wheel. For example, when cycling on a road-going bicycle in a low gear the user experiences a low pedal resistance because a higher number of crank arm revolutions are used to rotate the bicycle wheel a particular amount. Likewise, when cycling at a higher gear, the user experiences an increased pedal resistance, because a lower number of crank arm revolutions are used to rotate the bicycle wheel. Moreover, the user feels a greater pedal resistance when attempting to quickly accelerate a bicycle in a high gear than when attempting to quickly accelerate the bicycle in a low gear.

The linear momentum of a road-going bicycle (and the user) relates to the combined mass, or inertia, of the bicycle and the load that the bicycle is carrying (e.g., mass of the user and other objects) and to the velocity at which the bicycle is moving. Thus, a bicycle moving at a lower velocity has a lower linear momentum than when the same bicycle is moving at a higher velocity. Once the user is traveling at a particular velocity on the road-going bicycle, the linear momentum of the bicycle will continue to move the bicycle in the same direction. If the user stops pedaling the road-going bicycle, the linear momentum of the bicycle will continue to move the bicycle forward until parasitic forces, such as wind resistance and frictional losses, slow the bicycle down. For example, if a user operates a road-going bicycle on level ground and at a high gear, the user must exert a certain torque at the pedals to quickly accelerate the road-going bicycle. Once the user accelerates the road-going bicycle, the user may stop pedaling, or "coast," and will continue to travel forward for a certain period of time without exerting any torque on the pedals. The linear momentum of the user and the bicycle causes the bicycle (and the user) to travel forward for a certain amount of time.

In addition, the pedal resistance felt by a user varies with changes in velocity (i.e., accelerations and decelerations) of the user's pedal rotation. The magnitude of the change in pedal resistance is based on the gear in which the user is riding and on the magnitude of the acceleration or deceleration of the pedal rotation. For instance, a user experiences a greater increase in pedal resistance (i.e., must exert more effort to pedal) when attempting, in a particular gear, a large acceleration in the pedal rotation than when attempting a small acceleration in the pedal rotation. Moreover, a user experiences corresponding decreases in pedal resistance due to deceleration of the pedal rotation (coasting).

Unlike road-going bicycles, stationary bicycles generally do not obtain linear momentum during use and usually operate with a single-gear drivetrain. As a result, the pedal resistance felt by a user is generally related to at least: (1) the angular momentum of the stationary bicycle flywheel; and (2) a resistive load on the flywheel. Thus, in one embodiment of the invention, an electronic control changes the simulation pedal resistance of the stationary bicycle by adjusting the resistive load on the flywheel.

With respect to angular momentum, the pedal resistance of a stationary bicycle correlates to the weight or mass-distribution of the flywheel and the angular velocity of the flywheel. For example, a user operating a stationary bicycle with an equally distributed 100-pound flywheel at a certain angular velocity would generally experience a greater angular momentum than if the user operated the stationary bicycle with a 50-pound flywheel at the same angular velocity. Accordingly, the user would experience a greater pedal resistance while attempting to accelerate with the heavier flywheel. Likewise, a flywheel spinning at a low angular velocity will have a lower angular momentum than the same flywheel spinning at a high angular velocity.

Because, however, flywheels are generally of a fixed mass, the stationary bicycle may use a resistance device to vary the resistive load applied to the flywheel. Varying the resistive load of the flywheel, in turn, varies the simulation pedal resistance felt by the user. With an increase in the resistive load, the user must exert more effort, or torque, to rotate or accelerate the flywheel. Moreover, by the rotational resistive device applying appropriate variations to the resistive load of the flywheel, the stationary, single-gear bicycle more closely simulates the pedal resistance of a multi-gear road-going bicycle.

Based at least on the foregoing, the present disclosure includes disclosure of a stationary bicycle including an electronic control that simulates changes in pedal resistance similar to those felt while gear shifting a road-going bicycle. For example, when the user of the stationary bicycle shifts from a lower gear to a higher gear, the electronic control increases the simulation pedal resistance of the stationary bicycle by, for example, increasing the resistive load on the flywheel.

In another embodiment, the electronic control can advantageously vary the simulation pedal resistance of the exercise bicycle to more accurately simulate the momentum properties that a user generally experiences while riding a road-going bicycle. For example, the electronic control may vary the simulation pedal resistance based on a sensed acceleration or deceleration of the pedal rotation. In one embodiment, the electronic control adjusts the resistive load on the exercise bicycle flywheel based on changes in the angular velocity of the flywheel.

The electronic control may also advantageously vary the simulation pedal resistance of a stationary bicycle to more accurately simulate other resistance affecting factors that a user generally encounters on a road-going bicycle. For example, the electronic control may account for parasitic factors, such as wind resistance, wheel turbulence, and tire friction, or the grade (i.e., incline or decline) of the ride.

The features of the system and method will now be described with reference to the drawings summarized above. Throughout the drawings, reference numbers are re-used to indicate correspondence between referenced elements. The drawings, associated descriptions, and specific implementation are provided to illustrate embodiments of the invention and not to limit the scope of the invention.

FIG. 1 illustrates an exercise machine comprising a stationary bicycle 100 according to one embodiment of the invention. In particular, the stationary bicycle 100 comprises a recumbent exercise bicycle. In other embodiments, the exercise machine may advantageously comprise an upright bicycle, a semi-recumbent bicycle, other electronically controlled exercise machines, or the like.

As shown in FIG. 1, the bicycle 100 comprises rider positioning mechanisms 102, such as, for example, a handlebar assembly and a seat, a resistance applicator 104, such as pedals, an electronically controlled resistance mechanism 106, and an interactive display 108. FIG. 1 also illustrates a particular approachable structure for the recumbent exercise bicycle, comprising a walk-through design that facilitates user access to the bicycle.

As will be understood by a skilled artisan from the disclosure herein, a user can sit on the seat, optionally balance using the handlebar assembly, and perform exercises by pedaling the pedals similar to riding a road-going bicycle.

In one embodiment, the display 108 advantageously comprises an electronic readout or other suitable configuration that informs the user of certain data, such as the rate of speed, calories burned, the selected program workout, and the like. In addition, the display 108 preferably receives input of information by the user. For example, the display 108 may receive input as to the user's selection of a particular workout routine or level, the user's weight, the user's age, and/or a particular resistance level at which the user would like to operate the bicycle 100. The electronics relating to the display 108 can be connected to a power source. In other embodiments of the invention, electricity generated from pedaling by the user powers at least in part the display 108.

Although disclosed with reference to an embodiment, a skilled artisan will recognize from the disclosure herein a wide variety of alternative structures for the stationary bicycle 100. For example, in an embodiment of the invention, the handlebar assembly comprises a gear selector device (not shown). For instance, the handlebar assembly may advantageously include a hand shifter, similar to those used on road-going bicycles. In such an embodiment, the user selects the gear to be simulated by the stationary bicycle 100 by adjusting the hand shifter. In other embodiments, the handlebar assembly may advantageously include one or more actuators, keys, or the like usable to simulate shifting gears.

Figure 2:
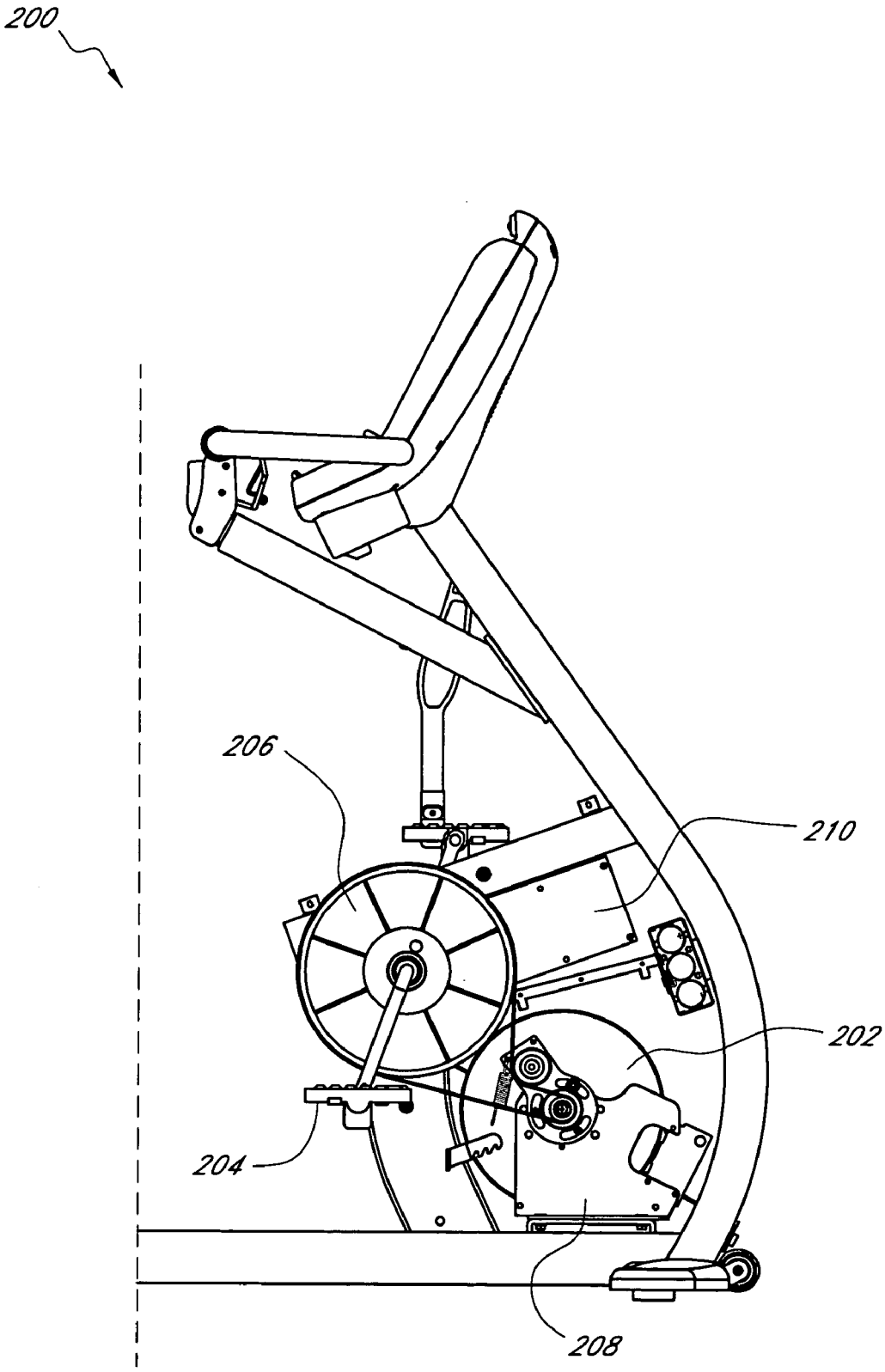
FIG. 2 illustrates a side view of an exemplary embodiment of a resistance region of the recumbent exercise bicycle of FIG. 1.

FIG. 2 illustrates further details of an electronically controlled resistance mechanism 200 usable by a stationary bicycle, such as the bicycle 100 of FIG. 1. As shown in FIG. 2, the resistance mechanism 200 comprises a flywheel 202, a resistance applicator 204, such as pedals, a crank 206, a rotational resistance device 208, such as, for example, an electromagnetic device, and a load control board 210.

As illustrated, the flywheel 202 is operatively coupled to the resistance applicator 204 and to the crank 206. A user-applied force to the resistance applicator 204, such as through a pedaling motion, causes rotation of the crank 206, which in turn causes rotation of the flywheel 202. The rotational resistance device 208 applies a resistive load to the flywheel 202, which translates back to the user as a simulation pedal resistance. Thus, as the rotational resistance device 208 increases the applied resistive load, a user encounters a greater resistance at the pedals and must exert more force to rotate them.

In an embodiment, the load control board 210 communicates with the rotational resistance device 208 to adjust the resistive load to the flywheel 202. The load control board 210 preferably receives at least one control signal, such as from a processor, indicative of the resistive load to be applied by the rotational resistance device 208. In one embodiment, the load control board 210 translates a signal from the processor into a signal capable of affecting the resistance device 208. A skilled artisan will recognize from the disclosure herein that the load control board 210 may advantageously include amplifiers, feedback circuits, and the like, usable to control the applied resistance to the manufacturer's tolerances. In other embodiments, the load control board 210 forwards the received signal to the rotational resistance device 208.

Although disclosed with reference to one embodiment, a skilled artisan will recognize from the disclosure herein a wide variety of mechanisms, devices, logic, software, combinations of the same, or the like, usable to control the application of the resistive load. For example, the load control board 210 may comprise a processor or a printed circuit board. In yet other embodiments, the resistance mechanism 200 may operate without a load control board 210. For example, the rotational resistance device 208 may receive a control signal directly from a processor located in the display, in other locations on the stationary bicycle, or in processing devices remotes from the bicycle, such as personal digital assistants (PDAs), cellular phones, or the like.

As will be understood by a skilled artisan from the disclosure herein, the rotational resistance device 208 may comprise any device or apparatus usable to apply a resistive load to the flywheel. For instance, the rotational resistance device 208 may comprise at least one electromagnet, such as, for example, an eddy coil apparatus, located in a fixed position proximate to the flywheel 202. The electromagnet applies an electromagnetic field to the flywheel 202, which results in a rotational resistance applied to the flywheel 202 and, thus, a pedal resistance experienced by the user when pedaling.

In an embodiment, an electronic control outputs an electrical signal that controls the strength of the electromagnet by adjusting the field coil current running through the electromagnet. For instance, the control signal may instruct the load control board 210 to vary the magnitude of the field coil current running through the electromagnet. In order to increase the rotational resistance applied to the flywheel 202, the electronic control increases the field coil current, which, in turn, increases the magnetic field, or resistive load, applied to the flywheel 202. Likewise, if the field coil current decreases, the electromagnet lessens the resistive load on the flywheel 202.

Although FIG. 2 illustrates the foregoing electronically controlled resistance mechanism 200, the skilled artisan will recognize from the disclosure herein other resistance mechanisms usable to adjust a pedal resistance felt by a user while pedaling on a stationary bicycle. For example, other types of rotational resistance devices may be used in combination with a flywheel 202. For instance, the rotational resistance device may comprise moveable magnets that adjust their positions with respect to the flywheel 202 in order to alter the rotational resistance. As the moveable magnets move closer to the flywheel 202, the resistive load on the flywheel 202 increases. In yet other embodiments of the invention, the rotational resistance device 208 may utilize one or more of the following technologies to control the simulation pedal resistance felt by the user: brake blocks, belts, adjustable magnetic forces; magnetic eddy current systems; electromagnetic eddy-current induction brakes; push brake handles; and air resistance systems that utilize fan blades; combinations of the same or the like.

Figure 3:
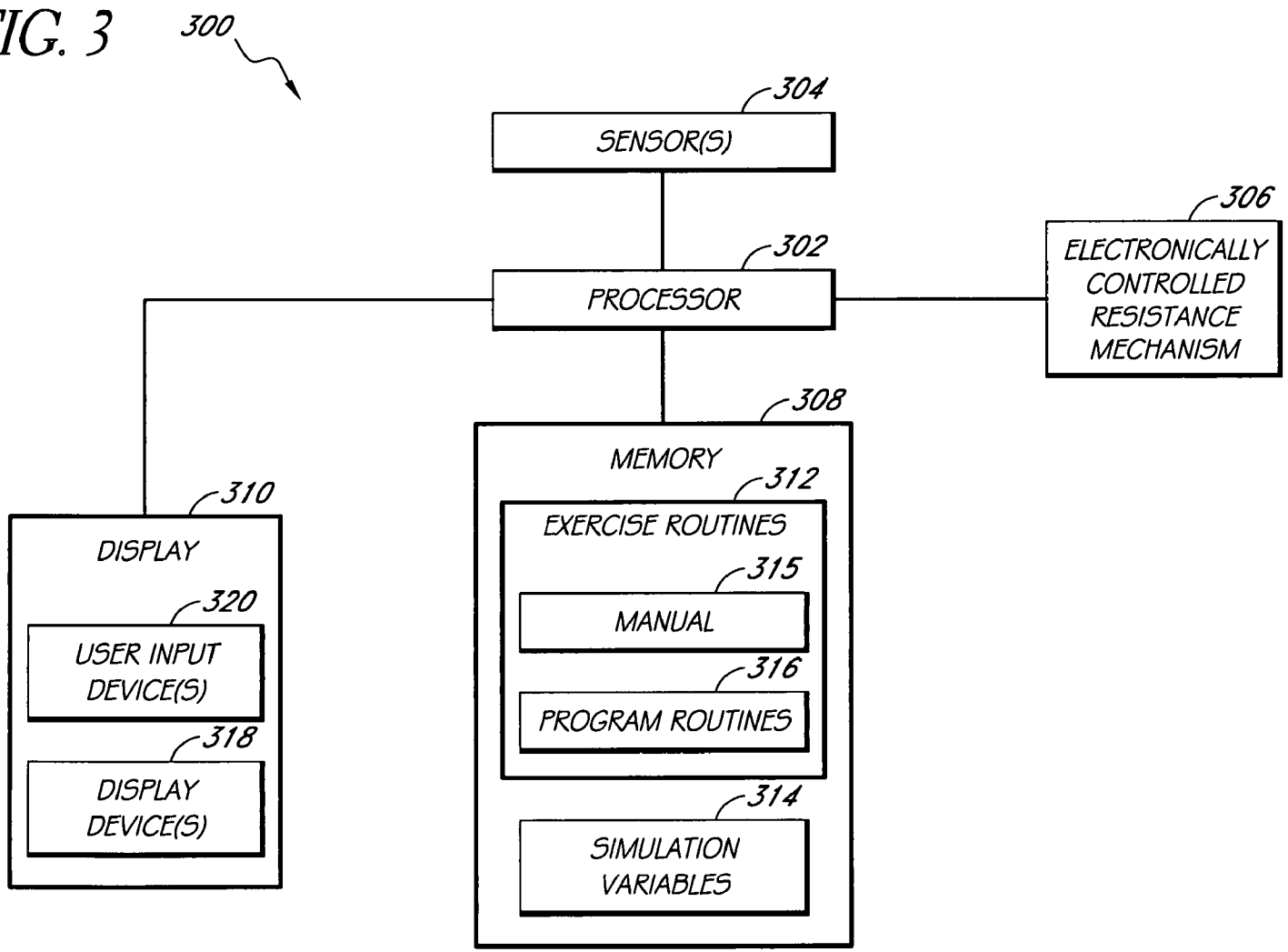
FIG. 3 illustrates a block diagram of an exemplary embodiment of a control system of the recumbent exercise bicycle of FIG. 1.

FIG. 3 illustrates a block diagram of an exemplary embodiment of a control system 300 usable by a stationary bicycle, such as the bicycle 100 of FIG. 1. As shown, the control system 300 comprises a processor 302 that communicates with at least one sensor 304, an electronically controlled resistance mechanism 306, a memory 308, and a display 310.

In one embodiment, the processor 302 comprises a general or a special purpose microprocessor. However, an artisan will recognize that the processor 302 may comprise an application-specific integrated circuit (ASIC) or one or more modules configured to execute on one or more processors. The modules may comprise, but are not limited to, any of the following: hardware or software components such as software object-oriented software components, class components and task components, processes, methods, functions, attributes, procedures, subroutines, segments of program code, drivers, firmware, microcode, applications, algorithms, techniques, programs, circuitry, data, databases, data structures, tables, arrays, variables, combinations of the same or the like.

As mentioned, the processor 302 communicates with at least one sensor 304. In an embodiment, the sensor 304 advantageously provides the processor 302 with a signal indicative of the user's pedal velocity. In an embodiment, the sensor 304 generates a signal each partial or full revolution of the flywheel. For instance, the sensor 304 may generate a tach pulse each 1/360 revolution (or 1 degree) of the flywheel. In other embodiments of the invention, the sensor generates tach pulses more or less often than each 1/360 revolution. By examining the amount of time that passes between each tach pulse, the processor 302 is able to determine the angular velocity, and any changes in the velocity, of the flywheel and, thus, the pedals.

Although disclosed with reference to one embodiment, an artisan will recognize from the disclosure herein other sensors usable in the control system 300. For example, the sensor 304 may be capable of measuring the angular velocity of the flywheel; the angular velocity of a rotatable crank; the rotational velocity of the pedals; the linear velocity of a belt drive; a user-applied force, such as at the pedals; the movement or rotation of the resistance mechanism 306; combinations of the same or the like. The sensor 304 may comprise an optical sensor, a magnetic sensor, a potentiometer, combinations of the same or the like, and may employ one or more encoding devices, such as, for example, one or more rotating magnets, encoder disks, combinations of the same or the like.

As shown in FIG. 3, the processor 302 also communicates with the electronically controlled resistance mechanism 306. In an embodiment, the processor 302 outputs a control signal to adjust the amount of resistance applied by the resistance mechanism 306. For example, the processor 302 preferably outputs one or more signals usable to vary the resistive load applied to the flywheel based on input received from the display 310 and/or the sensor 304. As discussed in the foregoing, a load control board may receive the control signal and output an appropriate signal to the resistance mechanism 306.

In one embodiment, the processor 302 communicates with the memory 308 to retrieve and/or to store data and/or program instructions for software and/or hardware. For example, the memory 308 may store information regarding exercise routines, user profiles, and variables used in calculating the appropriate resistive load to be applied by the resistance mechanism 306. As will be understood by a skilled artisan from the disclosure herein, the memory 308 may comprise random access memory (RAM), ROM, on-chip or off-chip memory, cache memory, or other more static memory such as magnetic or optical disk memory. The memory 308 may also access and/or interact with CD-ROM data, PDAs, cellular phones, laptops, portable computing systems, wired and/or wireless networks, combinations of the same or the like.

In one embodiment, the processor 302 and the memory 308 are housed within the display 310. In other embodiments of the invention, the processor 302 and/or the memory 308 are located within the resistance mechanism 306, such as on a load control board, or within or on other locations on the bicycle. In yet other embodiments, the processor 302 and/or memory 308 are located external to, or remote to, the bicycle. In yet other embodiments of the invention, a portion of the processor 302 may be housed in the display 310 and another portion of the processor may be located within the resistance mechanism 306.

Furthermore, FIG. 3 illustrates the processor 302 communicating with the display 310. The display 310 can have any suitable construction known to an artisan to display information and/or to motivate the user about current or historical exercise parameters, progress of the user's workout, and the like. In one embodiment, the display 310 advantageously comprises an electronic display.

Although the processor 302, the sensor 304, the resistance mechanism 306, the memory 308, and the display 310 are disclosed with reference to particular embodiments, a skilled artisan will recognize from the disclosure herein a wide number of alternatives for the processor 302, the sensor 304, the resistance mechanism 306, the memory 308, and/or the display 310.

Furthermore, as illustrated in FIG. 3, the memory 308 stores exercise routine data 312 and simulation variable data 314. As shown, exercise routine data 312 comprises manual exercise routine data 314 and preprogrammed routine data 316. In an embodiment, the simulation variable data 314 contains variables used by the processor 302 to calculate the appropriate flywheel resistive load based on information received through the display 310 and from the sensor 304.

A skilled artisan will recognize from the disclosure herein a wide variety of data usable by the control system 300 and storable in the memory 308. For example, in other embodiments, the memory 308 may also store information relating to user profiles and/or the cycling activity for a current routine.

Furthermore, as illustrated in FIG. 3, the processor 302 communicates with the display 310 to provide user output through at least one display device 318 and to receive user input through at least one user input device 320. For instance, the display device 318 may provide the user with information relating to his or her exercise routine, such as for example, the selected preprogrammed workout, the user's pedal velocity, the time expended or remaining in the exercise routine, the simulated distance remaining or traveled, the simulated velocity, the user's heart rate, a combination of the same or the like. The display device 318 may comprise, for example, light emitting diode (LED) matrices, a 7-segment liquid crystal display (LCD), a motivational track, a combination of the same, and/or any other device or apparatus that is used to display information to a user.

Furthermore, the user may input information, such as, for example, initialization data or resistance level selections, through the user input device 320 of the display 310. Such initialization data may include, for example, the weight, age, and/or sex of the user, the exercise routine selections, other demographic information, combinations of the same or the like. In fact, an artisan will recognize from the disclosure herein a wide variety of data usable to calculate exercise progress or parameters. The user input device 320 may comprise, for example, buttons, keys, a heart rate monitor, a touch screen, PDA, cellular phone, combinations of the same or the like. Moreover, an artisan will recognize from the disclosure herein a wide variety of devices usable to collect user input.

According to an embodiment, the display 310 includes a gear selector. In one embodiment, the gear selector outputs to the processor 302 a signal representing the cycling gear input by the user. The processor 302, in turn, uses the gear selection to calculate the resistance to be applied by the resistance mechanism 306. In one embodiment, the gear selector is a button on the display 310 that the user presses to change the gear of the routine.

Although disclosed with reference to an embodiment, an artisan will recognize from the disclosure herein a wide variety of alternative structures and functions for the gear selector. For example, the gear selector may comprise a mechanical lever or hand shifter similar to that found on a road-going bicycle. In other embodiments, the gear selector comprises a knob or switch on the display 310, or the user may enter a specific number into the display 310 that represents the gear selection. In an embodiment, the output signal from the gear selector is usable as initialization data and/or as updated data during the performance of the cycling routine. In yet other embodiments, the processor 302 automatically controls the gear selector according to a selected preprogrammed routine.

For exemplary purposes, a method of operation of the control system 300 will be described with reference to the elements depicted in FIG. 3. A user preferably positions himself or herself on the stationary bicycle and inputs certain initialization data in the display 310. As mentioned, such initialization data may include a particular workout program or level, the desired length (in time or distance) of the workout, the user's weight, a gear or resistance level for the workout, combinations of the same or the like. The user then begins the cycling routine preferably by rotating the bicycle pedals. When exerting a force on at least one of the pedals, and therefore on one of the crank arms, the user applies a torque to the crank that causes rotation of the crank.

Rotation of the crank causes rotation of the flywheel. The resistance felt by the user in rotating the pedals correlates to the resistive load applied to the flywheel. In one embodiment of the invention, the user controls the resistive load of the flywheel through commands entered through the user input device 320 of the display 310. For example, the user may select a workout routine that automatically varies the resistive load of the flywheel. In other embodiments, the user has the option of increasing or decreasing the resistive load setting or may temporarily override the default resistive load settings by inputting additional information.

In one embodiment of the invention, the resistance mechanism 306 varies the resistive load of the flywheel to more closely simulate the pedal resistance experienced when cycling on a road-going bicycle. In one embodiment, the electronic control system 300 adjusts the resistive load on the flywheel to simulate the changes in pedal resistance that result from the shifting of gears of a road-going bicycle. For example, suppose a user is pedaling the bicycle at sixty pedal revolutions per minute (RPM), and shifts to a higher gear such as by, for example, actuating a gear selector. The processor 302 detects this gear selection and outputs a signal to the resistance mechanism 306 to increase the resistive load applied to the flywheel. If the user maintains the same pedal velocity (i.e., 60 RPM) in the same gear, the user feels an increased simulation pedal resistance due to the increased flywheel resistive load. As a result, the user must apply a greater torque to compensate for the increased resistive load if a constant pedal velocity is to be maintained.

Likewise, if the user downshifts while maintaining a constant pedal velocity, the control system 300 decreases the resistive load applied to the flywheel to more closely to simulate the change in pedal resistance experienced when shifting to a lower gear on a road-going bicycle. As a result, the user applies less torque at the pedals to maintain the pedal velocity of 60 RPM.

In an embodiment, the total resistive load applied to the flywheel comprises at least a static resistive load. In one embodiment of the invention, the static resistive load is the total resistive load applied to the flywheel when the pedal velocity is constant (i.e., no acceleration or deceleration of the pedal rotation). In one embodiment of the invention, the processor 302 calculates the static resistive load based at least in part on the selected gear. In other embodiments, the processor 302 calculates the static resistive load by determining other resistance affecting factors, such as wind resistance and friction. In certain embodiments, the static resistive load increases linearly with each subsequent gear. In other embodiments, the static resistive load may increase non-linearly, such as exponentially, with each subsequent gear.

In a further embodiment of the invention, the total resistive load applied to the flywheel also comprises a dynamic resistive load. In one embodiment of the invention, the dynamic resistive load is based, at least in part, on changes in pedal velocity. For example, when the user increases the pedal velocity, the control system 300 increases the total resistive load. That is, the total resistive load is equal to the dynamic resistive load plus the static resistive load. When the pedal velocity decreases, the control system 300 decreases the total resistive load. That is, the dynamic resistive load takes on a negative value and causes the total resistive load applied to the flywheel to be less than the static resistive load.

In one embodiment of the invention, the control system 300 adjusts the resistive load, and therefore the simulation pedal resistance, in response to acceleration or deceleration of the pedal rotation. In particular, the control system 300 adjusts the resistive load to more closely simulate the linear momentum of a road-going bicycle. For instance, the shifting of gears of a road-going bicycle, while maintaining a constant pedal velocity, results in a change in linear momentum of the bicycle. A user operating a road-going bicycle at a pedal velocity of 60 RPM in a low gear experiences a lower linear momentum than when operating the road-going bicycle at the same pedal RPM in a high gear. The greater the linear momentum of the road-going bicycle, the further the bicycle travels if the user stops pedaling or decelerates the pedal velocity, such as while coasting.

As described previously, to more closely simulate the shifting into a higher gear, the resistance mechanism 306 increases the total resistive load (by increasing the static resistive load) applied to the flywheel. However, if this increased total resistive load remains constant after the user stops pedaling or decelerates, the resistive load (simulating the higher gear) will cause the flywheel to stop rotating at a faster rate than if the resistive load had not increased (such as in the lower gear). As a result, and unlike what occurs with the operation of a road-going bicycle, the user would lose the increased momentum (e.g., angular momentum of the flywheel), that he or she had gained while pedaling at the higher gear. The user would also encounter excess pedal resistance, due to the increased flywheel resistive load and the corresponding loss of the flywheel momentum, when attempting to re-accelerate after the period of deceleration or coasting.

Therefore, to simulate the linear momentum experienced by a user on a road-going bicycle, and to prevent unwanted loss of angular momentum of the flywheel, the resistance mechanism 306 decreases the total resistive load applied to the flywheel when the sensor 304 detects a decrease in the pedal velocity (i.e., deceleration). As a result, the user experiences a decrease in the simulation pedal resistance of the bicycle when the user decreases the pedal velocity, such as during coasting. In addition, the flywheel retains its angular momentum, which more closely simulates the effects of linear momentum of a road-going bicycle.

In addition to adjusting the resistive load in response to deceleration of the pedal rotation, the control system 300 also increases the resistive load in response to acceleration of the user's pedal rotation. Thus, when a user attempts to accelerate, or increase the pedal velocity, the resistance mechanism 306 increases the resistive load on the flywheel. As a result, the user encounters an increased simulation pedal resistance when increasing his or her pedal velocity.

In one embodiment, the control system 300 adjusts the resistive load of the flywheel multiple times during a single revolution, or stroke, of the pedal. The pedal stroke of a user is generally not a constant torque but includes a pattern of high effort surges. Consequently, the crank and the flywheel are subject to a pattern of accelerations and decelerations. For example, while pedaling the bicycle, a user tends to exert force on only one pedal at a time. A substantial portion of this force on the pedal generally occurs during the half-revolution of the crank arm in which the pedal moves from a position closest to the user to a position furthest away from the user. These two points generally correspond to when the user's leg moves from a position of approximately least leg extension to a position of greatest leg extension (e.g., the downstroke when using an upright bicycle).

Figure 4:
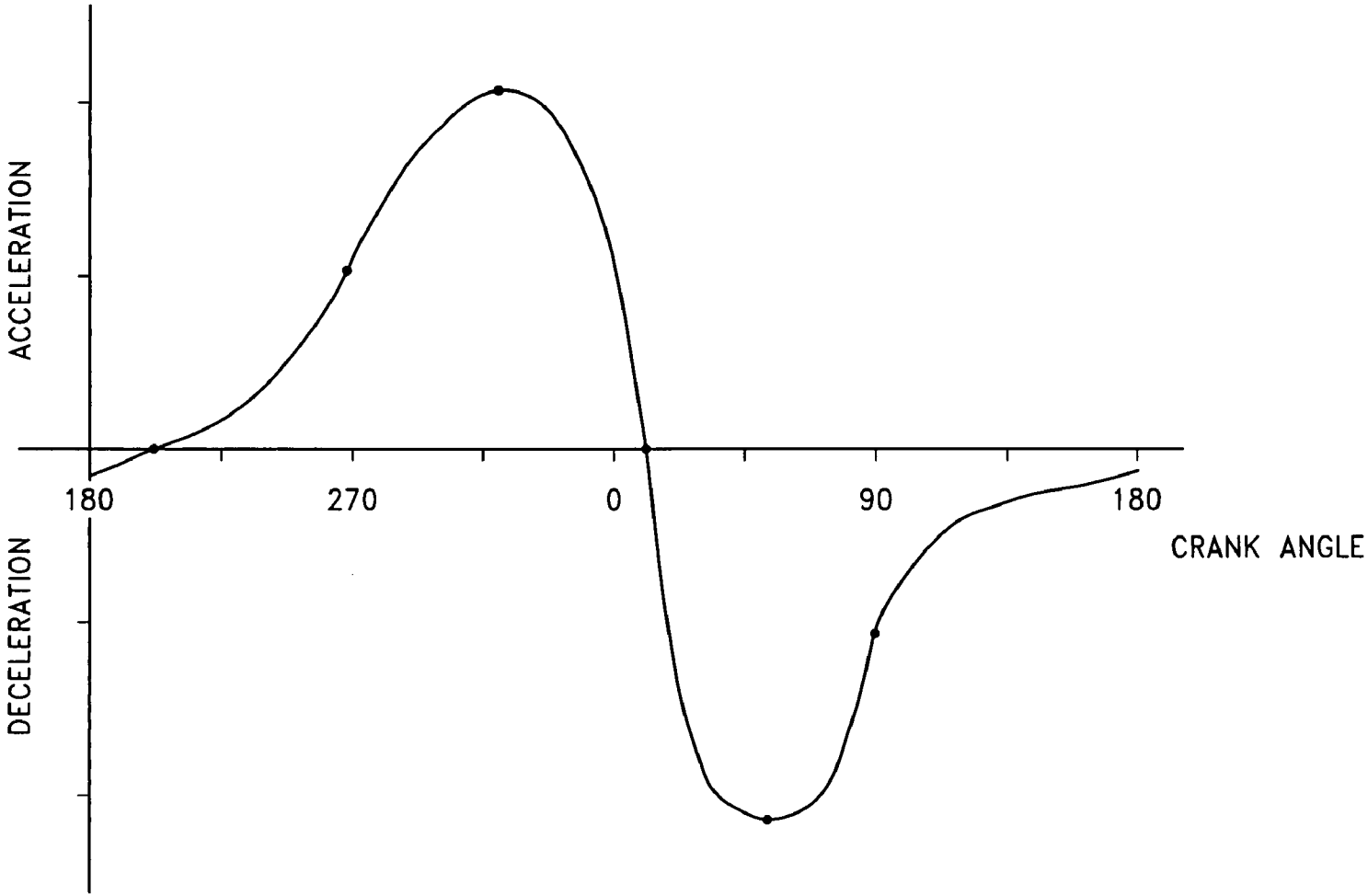
FIG. 4 illustrates a graph of acceleration and deceleration as a function of a crank arm angle while rotating through a pedal stroke of the recumbent exercise bicycle of FIG. 1.

The point of a pedal stoke at which a user exerts the greatest force on the pedal varies for different users and for different types of bicycles. FIG. 4 illustrates a graph depicting an example of the acceleration and deceleration that occurs during a single pedal stroke on a recumbent style stationary bicycle, such as the bicycle 100 depicted in FIG. 1. The graph plots acceleration (the positive y-axis) and deceleration (the negative y-axis) of the pedal rotation as a function of the crank arm angle. The crank arm angle of 270 degrees generally corresponds to the point at which the pedal is closest to the user. The crank arm angle of 0 degrees generally corresponds to the point at which the pedal is at the peak of its rotation and at which the crank arm is perpendicular to the ground surface. The crank arm angle of 90 degrees generally corresponds to the point at which the pedal is furthest from the user. The crank arm angle of 180 degrees generally corresponds to the point at which the pedal is at its lowest position.

In an embodiment of the invention wherein the resistive load comprises a dynamic resistive load portion that corresponds to acceleration/deceleration of the pedal rotation, FIG. 4 depicts approximate variations in the simulation pedal resistance during a pedal stroke. At the points of greatest acceleration during the pedal stroke, the total resistive load and the simulation pedal resistance are generally the greatest. At the points of greatest deceleration during the pedal stroke, the total resistive load and the simulation pedal resistance are generally at their lowest values.

Figure 5A:
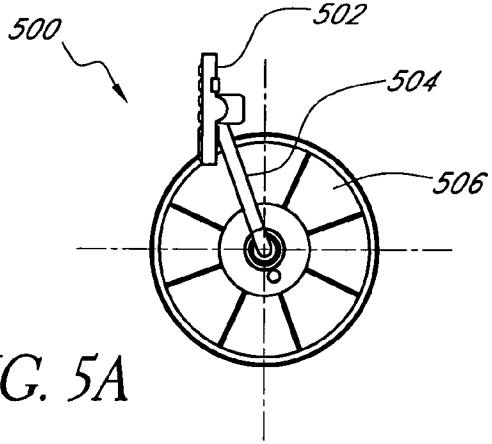
FIGS. 5A-5D illustrate various positions of a pedal while rotating through a pedal stroke of the recumbent exercise bicycle of FIG. 1.

FIGS. 5A through 5D depict positions of a pedal 502 and a crank arm 504 while rotating a crank 506 of a recumbent style bicycle, such as the bicycle 100 of FIG. 1, where the user's legs extend generally horizontally to the pedals. FIG. 5A illustrates a position 500 of the crank arm 504 and the pedal 502 when the user tends to exert the greatest acceleration during a pedal stroke. Thus, at position 500 the flywheel generally experiences the greatest increase in angular velocity. Upon sensing this acceleration, a control system, such as the control system 300 of FIG. 3, may increase the resistive load on the flywheel to increase the simulation pedal resistance. Without the increased resistive load on the flywheel, the user would not encounter the necessary pedal resistance to counteract the increased force on the pedal 502. In such a situation, without the increased resistance, the pedal 502 would rotate more freely and easily than what is experienced when attempting to accelerate a road-going bicycle. Thus, at the position 500 illustrated in FIG. 5A, the user will generally experience the greatest simulation pedal resistance during the pedal stroke.

Figure 5B:
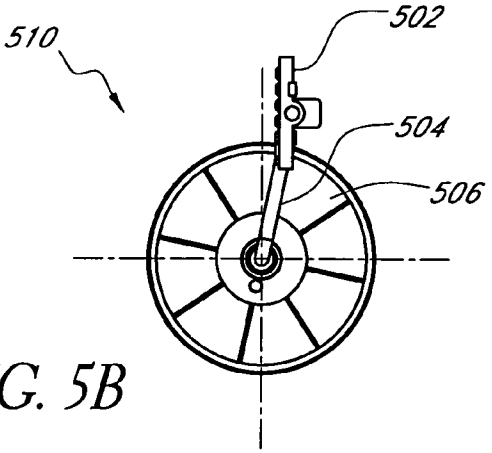

FIG. 5B illustrates a position 510 at which the pedal 502 and the crank arm 504 generally experience the lowest change in pedal velocity. At position 510, the user usually begins to decelerate during the pedal stroke (i.e., to decrease the pedal velocity). As a result, the dynamic resistive load applied by the control system is approximately zero. Thus, at position 510 illustrated in FIG. 5B, the total resistive load on the flywheel is approximately equal to the static resistive load.

Figure 5C:
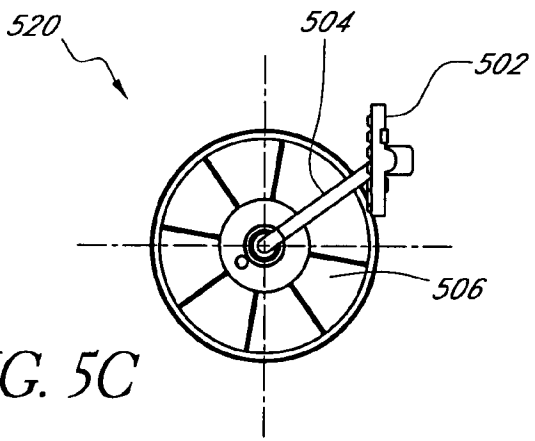

FIG. 5C illustrates a position 520 of the pedal 502 and the crank arm 504 when the greatest deceleration generally occurs during the pedal stroke. At position 520, the flywheel experiences the greatest decrease in angular velocity. Upon sensing this deceleration, the control system may decrease the total resistive load on the flywheel in order to decrease the simulation pedal resistance felt by the user. Thus, at position 520 illustrated in FIG. 5C, the user will generally experience the least simulation pedal resistance during the pedal stroke.

Figure 5D:
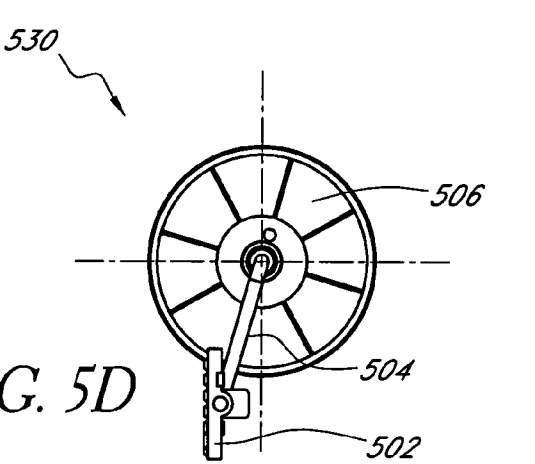

FIG. 5D illustrates a position 530 at which the pedal 502 and the crank arm 504 again generally experience the lowest change in pedal velocity. At position 530, the user usually begins to accelerate during the pedal stroke (i.e., to increase the pedal velocity). As a result, the dynamic resistive load applied by the control system is approximately zero. Thus, at position 530 illustrated in FIG. 5D, the total resistive load on the flywheel is approximately equal to the static resistive load.

In embodiments of the invention in which the pedals 502 include harnesses or foot straps, the user may be able to exert a pulling force on the pedal 502. Consequently, patterns of acceleration and deceleration during the pedal stroke may differ slightly when such harnesses or foot straps are used.

A skilled artisan will recognize from the disclosure herein that patterns of acceleration and deceleration may vary depending on the user and depending on what style of exercise bicycle is used. For example, when using an upright stationary bicycle, the greatest acceleration of the pedal stroke may occur at position 520 illustrated in FIG. 5C.

Figure 6:
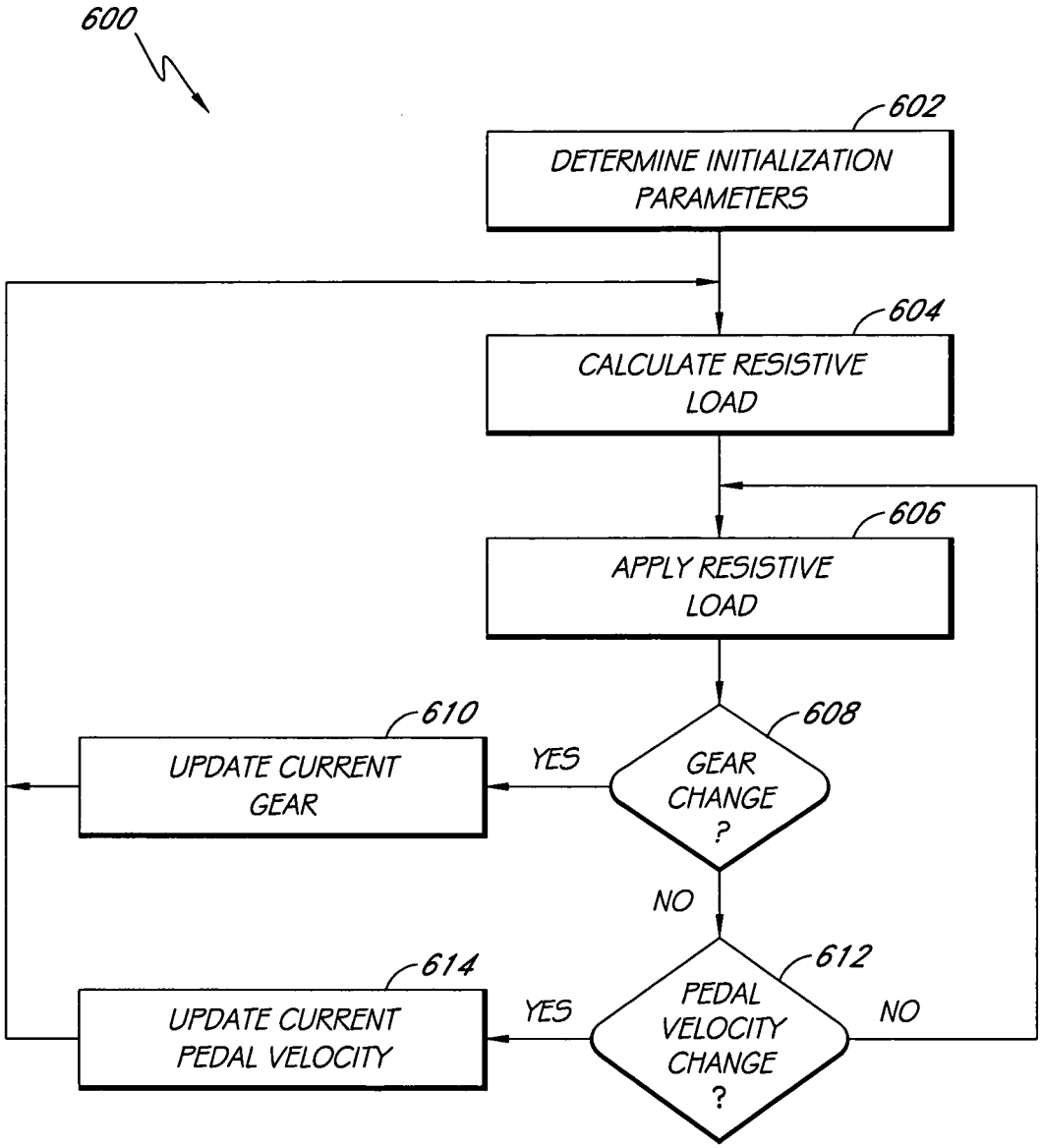
FIG. 6 illustrates a simplified flow chart of an exemplary embodiment a resistance control process.

FIG. 6 illustrates a simplified flow chart of a resistance control process 600 usable by the stationary bicycle 100 of FIG. 1. In one embodiment, the control system 300 of FIG. 3 executes the process 600 to simulate the pedal resistance experienced while riding a road-going bicycle.

In an embodiment, the processor 302 advantageously executes the process 600 as a collection of software instructions written in a programming language. In other embodiments of the invention, the control system 300 implements the process 600 as logic and/or software instructions embodied in firmware or hardware, such as, for example, gates, flip-flops, programmable gate arrays, processors, combinations of the same or the like. Furthermore, the control system 300 may also implement the process 600 as an executable program, installed in a dynamic link library, or as an interpretive language such as BASIC. The process 600 may be callable from other modules or from themselves, and/or may be invoked in response to detected events or interrupts.

For exemplary purposes, the process 600 will be described herein with reference to components of the control system 300 depicted in FIG. 3. At Block 602, the process 600 determines initialization parameters. For example, in one embodiment of the invention, the processor 302 receives data relating to the weight of the user and the grade, such as the amount of incline or decline, of the simulated ride. In one embodiment, the user enters at least one initialization parameter. In other embodiments of the invention, the processor 302 receives the initialization parameters from the memory 308, such as from the simulation variables 314. In other embodiments, the processor 302 receives the initialization parameters from PDAs, cellular phones, or other separate computing devices.

In another embodiment of the invention, the initialization parameters include an initial gear selection. This gear selection may be automatically set based on a default gear selection or based on a gear selection that is part of a preprogrammed exercise routine. In other embodiments of the invention, the user inputs the gear selection, such as through the user input device 318 of the display 310 or through another device, such as a gear selector or a hand shifter, as described previously herein.

At Block 604, the processor 302 calculates a resistive load. In one embodiment of the invention, the resistive load is the total resistive load to be applied to the flywheel. For example, the processor 302 may calculate the total resistive load based on the initialization parameters and/or based on other input received from other components of the control system 300.

At Block 606, the resistance mechanism 306 applies the resistive load, which translates back to the pedals as a simulation pedal resistance. In one embodiment of the invention, the resistance mechanism 306 applies the total resistive load to a flywheel, such as, for example, by applying an electromagnetic load.

At Block 608, the control system 300 determines if there is a change in the gear selection. If there is a change in the gear selection, the processor 302 at Block 610 updates the current gear selection and returns to Block 604 to recalculate the resistive load.

If at Block 608 the gear does not change, the control system 300 at Block 612 determines if there is a change in the rotational velocity (i.e., acceleration or deceleration) of the pedals. In one embodiment of the invention, the sensor 304 outputs a signal to the processor 302 indicative of the pedal velocity. For example, the sensor 304 may monitor the angular velocity of the flywheel. Increases or decreases in the angular velocity of the flywheel correspond to increases or decreases in the pedal rotational velocity. In other embodiments of the invention, the sensor 304 monitors the angular velocity of the crank or the velocity of other components of the stationary bicycle that move in response to pedaling by the user.

In an embodiment, the processor 302 calculates changes in the pedal rotational velocity based on changes in the instantaneous angular velocity of the flywheel. For instance, the processor 302 may determine the instantaneous velocity of the flywheel each time the processor 302 receives a signal, such as a tach pulse that represents a partial revolution of the flywheel. By calculating the time between each tach pulse, the processor 302 determines the rotational velocity the flywheel. In other embodiments, the processor 302 determines changes in velocity by comparing average angular velocities calculated over a certain length of time, such as for example every 0.01 second, or over a certain number of tach pulses. The processor 302 may calculate an average angular velocity to prevent from overadjusting to slight velocity changes.

Although described with reference to the foregoing embodiments, a skilled artisan will recognize from the disclosure herein a wide variety of alternatives for sensing changes in pedal velocity. For example, the sensor 304 may detect the amount of force applied to the pedals or the amount of torque experienced by the crank. In such embodiments, the processor 302 may calculate accelerations or decelerations of the pedal rotation based at least in part on this detected force or torque.

If there is a change in the rotational velocity of the pedals, the control system 300 at Block 614 updates the current pedal velocity. In one embodiment, the processor 302 updates a pedal velocity variable stored in the memory 308. After updating the current pedal velocity, the process 600 returns to Block 604 to recalculate the resistive load.

In certain embodiments of the invention, the processor 302 identifies variations in the pedal velocity, or in the flywheel angular velocity, that exceed a certain threshold. For example, the processor 302 may detect variations in velocity that exceed two percent. Variations in velocity that do not exceed this threshold are filtered out and do not cause the process 600 to move to Block 614. In other embodiments, the threshold may correspond to acceleration, such as changes in velocity of two percent per second. In yet other embodiments, other threshold values may be used, such as thresholds of less than two percent per second or thresholds that are greater than two percent per second.

If at Block 612 there is no change in the pedal velocity, the process 600 returns to Block 606.

As has been described previously herein, there may be multiple accelerations and/or decelerations of the flywheel during a single pedal stroke. Thus, the control system 300 may continuously execute the process 600 throughout the pedal stroke. Furthermore, the control system 300 may change the total resistive load on the flywheel multiple times during a single pedal stroke.

A skilled artisan will recognize from the disclosure herein that the blocks described with respect to the process 600 illustrated in FIG. 6 are not limited to any particular sequence. Rather, the blocks can be performed in other sequences that are appropriate. For example, described blocks may be performed may be executed in parallel, or multiple blocks may be combined in a single block. Furthermore, not all blocks need to be executed or additional blocks may be included without departing from the scope of the invention. For instance, in an embodiment of the invention that does not include a gear selection, the resistance control process 600 may omit blocks 608 and 610.

Figure 7:
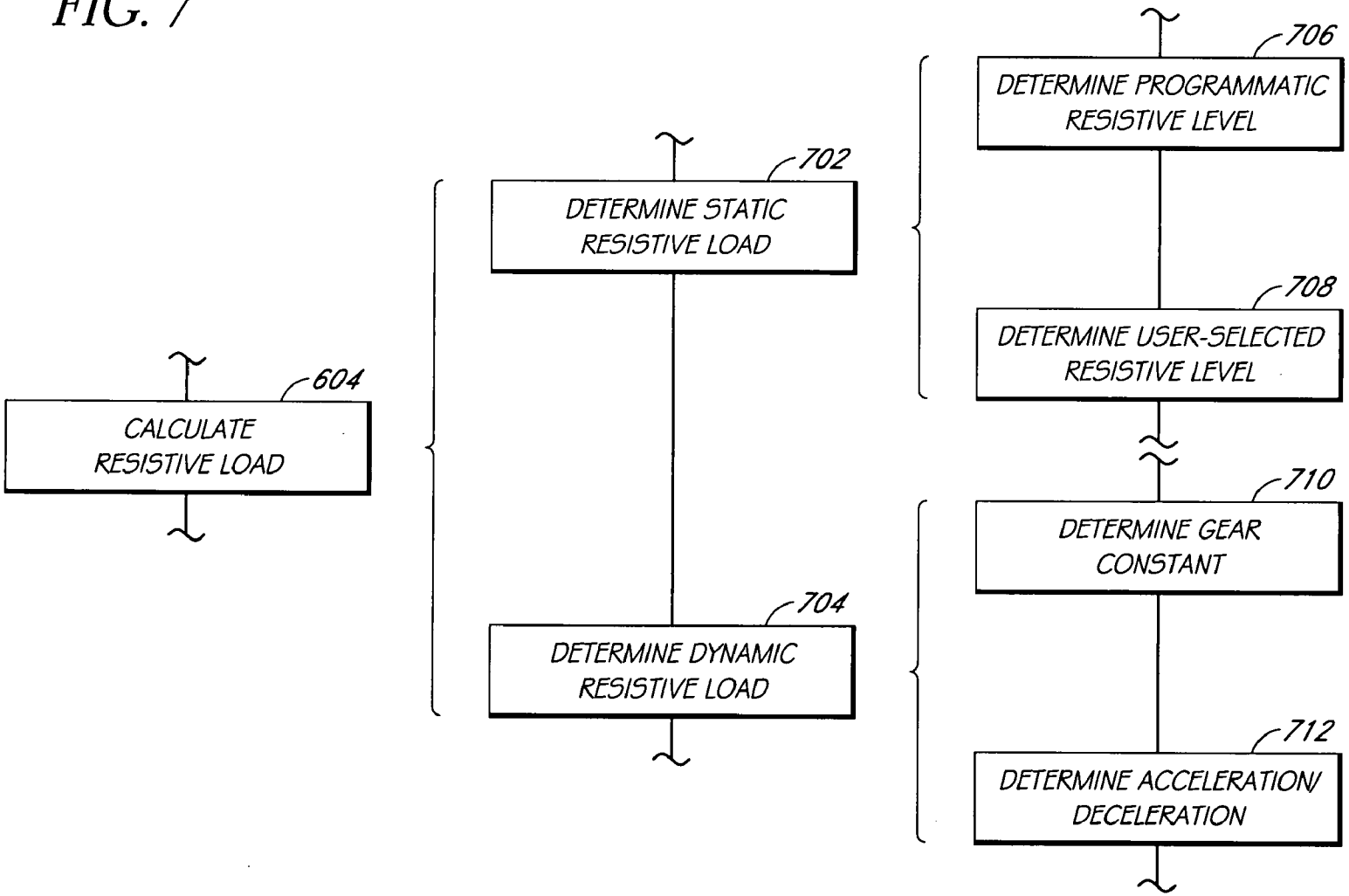
FIG. 7 illustrates a simplified flow chart of an exemplary embodiment of a resistive load calculation of the resistance control process of FIG. 6.

As can be appreciated, calculating the resistive load, as represented by Block 604 of FIG. 6, may depend on several intermediate calculations and/or determinations. FIG. 7 illustrates a simplified flow chart of an exemplary embodiment of a resistive load calculation of the resistance control process 600 of FIG. 6. For exemplary purposes, the blocks illustrated in FIG. 7 will be described with reference to the control system 300 of FIG. 3.

As shown in FIG. 7, calculating the resistive load (Block 604) may comprise the two intermediate determinations shown in Blocks 702 and 704. As illustrated by Block 702, the control system 300 determines a static resistive load. In an embodiment, the static resistive load is the portion of the resistive load that is independent of changes in the pedal velocity of the user.

As shown in Block 704, the control system 300 also determines a dynamic resistive load. In an embodiment, the dynamic resistive load varies based on changes in pedal velocity. As previously described herein, the dynamic resistive load determination may cause the resistive load to increase or decrease from the static resistive load.

As illustrated in FIG. 7, determining a static resistive load (Block 702) may further comprise additional calculations or determinations. At Block 706, the control system 300 determines the programmatic resistance level. In an embodiment, the processor 302 may retrieve simulation variables 314 from the memory 308 that correspond to a selected workout routine or a preset program. For example, if the user selects a preset program simulating cycling on hills, the programmatic resistance level may vary throughout the cycling routine based on if the simulated ride is at an uphill stage or a downhill stage.

At Block 708, the control system 300 determines a user-selected resistance level. For example, in one embodiment, the user may select a resistance level between 0 and 15, wherein Level 0 is associated with the lowest resistive load (lowest pedal resistance) and Level 15 is associated with the highest resistive load (highest pedal resistance). In an embodiment, the user may enter the resistance level selection through the display 310. Thus, the process 600 may advantageously combine Block 706 and Block 708 to determine the static resistive load. In other embodiments, the process 600 may further combine other parameters or resistance-affecting factors to determine the static resistive load.

As also illustrated in FIG. 7, determining a dynamic resistive load (Block 704) may further comprise additional calculations or determinations. At Block 710, the control system determines a gear constant. For example, the processor 302 may retrieve from the memory a simulation variable 314 that associates particular values with selected gears. Preferably, higher gears are associated with higher gear constant values. That is, with other parameters being equal, a higher gear selection results in a greater change in the dynamic resistive load than a lower gear selection.

At Block 712, the control system determines the acceleration or deceleration of the pedal rotation. In an embodiment, an acceleration of the pedal rotation results in a positive dynamic resistive load, which causes the resistive load to be greater than the static resistive load. In addition, a large acceleration increases the dynamic resistive load more than a small acceleration. Likewise, a deceleration of the pedal rotation results in a negative dynamic resistive load, which causes the resistive load to be less than the static resistive load. In addition, a large deceleration decreases the dynamic resistive load more than a small deceleration.

In one embodiment of the invention, the resistive load calculation of Block 604 comprises the following formula:

$$R=L+K(\partial V/\partial t)$$

wherein R is the resistive load applied to a flywheel; L is the static resistive load; K is a selected gear constant, wherein a lower gear is associated with a lower value of K and a higher gear is associated with a higher value of K; V is the angular velocity of the flywheel 36; and t is time. Thus, the resistive load of the flywheel is equal to the static resistive load of the flywheel plus or minus changes in resistance due to accelerations or decelerations of the flywheel (the dynamic resistive load). When the velocity of the flywheel is constant (i.e., the user is not accelerating or decelerating the pedal rotation), the flywheel resistive load is equal to the static resistive load. As also can be seen, the magnitude of the change in the dynamic resistive load is proportional to the magnitude of the change of the flywheel angular velocity. In other embodiments of the invention, other formulas may be used to calculate the resistive load without departing from the scope of the invention.

Although described with reference to the foregoing embodiments, a skilled artisan will recognize from the disclosure herein a wide variety of alternative calculations or determinations for calculating the resistive load. For example, in calculating a resistive load for a stationary bicycle not having a gear selection, Block 710 would be omitted. In another embodiment, the user-selected resistance level determination in Block 708 may temporarily replace the programmatic resistance level determination in Block 706.

Figure 8:
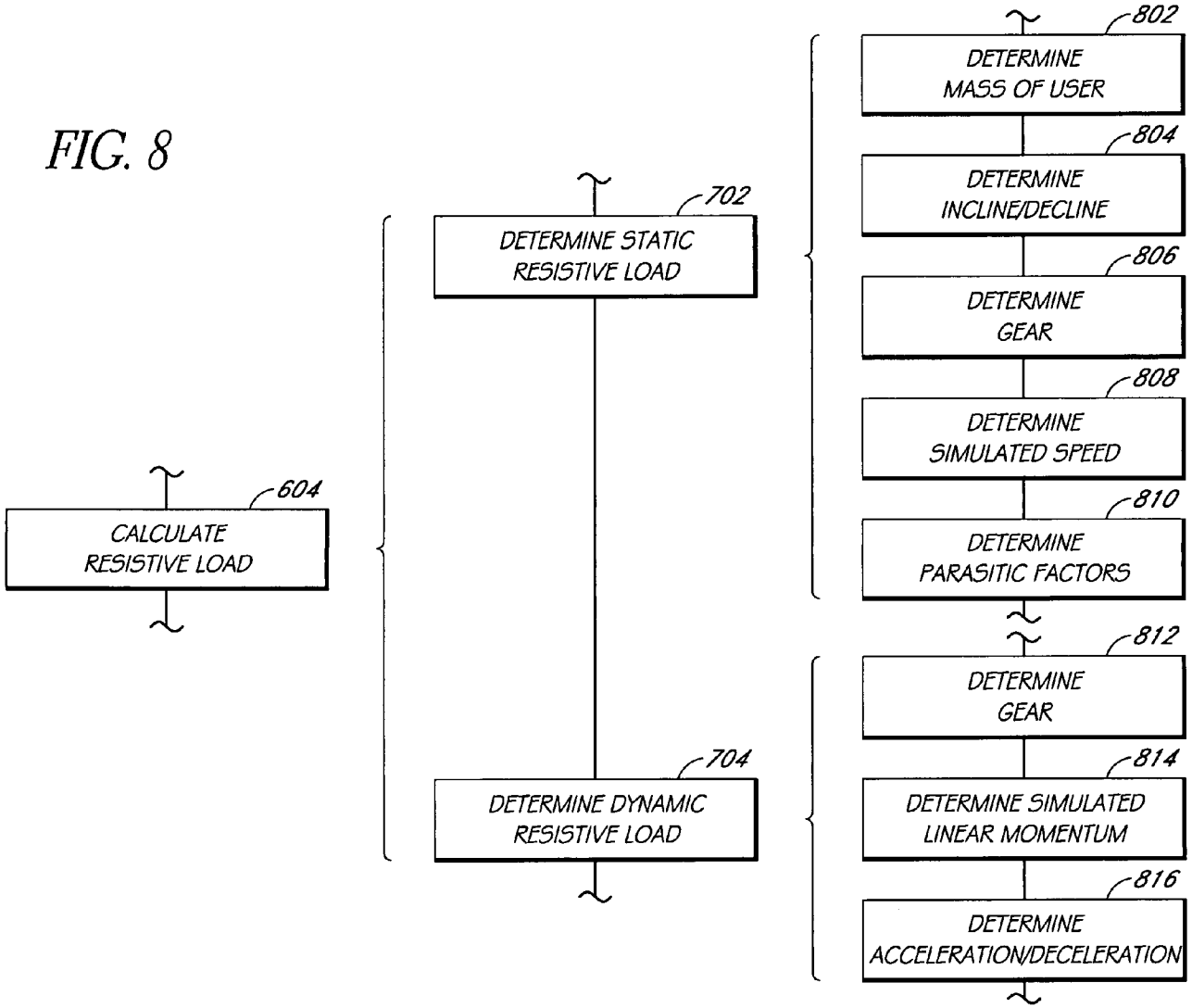
FIG. 8 illustrates a simplified flow chart of another exemplary embodiment of a resistive load calculation of the resistance control process of FIG. 6.

For example, FIG. 8 illustrates a simplified flow chart of another exemplary embodiment of a resistive load calculation of the resistance control process 600 of FIG. 6. Similar to that of FIG. 7, FIG. 8 illustrates calculating the resistive load (Block 604) by determining both a static resistive load (Block 702) and a dynamic resistive load (Block 704). For exemplary purposes, the blocks of FIG. 8 will be described herein with reference to the control system 300 of FIG. 3.

As shown in FIG. 8, determining the static resistive load may comprise several intermediate calculations and/or determinations. For example, at Block 802, the control system 300 determines the mass of the user. For example, the processor 302 may receive the mass of the user as an initialization parameter, such as during Block 602 of FIG. 6, or the processor 302 may use a default value stored in the memory 308. In other embodiments, the sensor 304 measures the mass of the user directly.

At Block 804, the control system 300 determines the simulated incline or decline of the cycling routine. For example, the processor 302 may receive from the memory 308 variables corresponding to the user-selected workout program. At Block 806, the control system 300 determines the selected gear. At Block 808, the control system 300 determines the simulated speed. For example, the processor 302 may determine the simulated speed based on factors such as the user's pedal velocity, the size of the flywheel, the selected gear, combinations of the same or the like. At Block 810, the control system 300 determines the effect of parasitic factors, such as, for example, wind resistance, wheel turbulence, and/or tire friction.

As will be appreciated, one or more of the illustrated determinations in Blocks 802-810 may depend on received initialization parameters, dynamic calculations, or other determinations. For example, when determining resistance-affecting parasitic factors at Block 810, such as for example wind resistance, the control system 300 may need to take into account the mass of the user, which is determined in Block 802, and/or the simulated speed, which is determined at Block 808. In addition, some determinations may need to be performed only once per cycling routine, such as determining the mass of the user at Block 802, while other determinations may be updated throughout the cycling routine.

As shown in FIG. 8, determining the dynamic resistive load may comprise multiple intermediate calculations and/or determinations. For example, at Block 812, the control system 300 determines the gear selection of the user. At Block 814, the control system determines the simulated linear momentum of the routine. In one embodiment, the processor 302 advantageously calculates the simulated linear momentum using the mass of the user and the simulated speed of the routine. The processor 302 may also take into account the mass of the simulated bicycle and/or the grade of the simulated ride. As shown in Block 816 of FIG. 8, the control system 300 also determines the acceleration or deceleration of the pedal velocity.

Although described with reference to the foregoing embodiments, a skilled artisan will recognize from the disclosure herein a wide variety of alternative calculations or determinations for calculating the resistive load. For example, the control system 300 may take into account the simulation of riding on different types of bicycles, such as a 10-speed bicycle or a mountain bicycle.

In another embodiment of the invention, the bicycle is further configured to simulate the linear momentum gained while traveling downhill on a road-going bicycle. For example, the bicycle may comprise a small motor that assists the rotation of the flywheel. In such an embodiment, the angular momentum of the flywheel may increase without the user rotating the pedals. In other embodiments, the rotational resistance mechanism may assist the rotation of the flywheel, such as through the use of changing or pulsating magnetic fields.

While certain embodiments of the inventions have been described, these embodiments have been presented by way of example only, and are not intended to limit the scope of the inventions. For example, other exercise machines, such as stairclimbers, natural runners, or elliptical machines, may utilize an electronically controlled resistance system or method as described herein. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A stationary bicycle capable of approximately simulating a pedal resistance felt by a rider of a multi-gear, road-going bicycle, the stationary bicycle comprising:

a flywheel;

a rotatable crank connected to the flywheel such that rotation of the crank translates into rotation of the flywheel;

pedals rotatably attached to the crank;

an electronically controlled resistance device configured to interact with the flywheel to apply a resistance to the flywheel, wherein the resistance is translated back to the pedals causing a user to exercise, the applied resistance comprising a dynamic resistive load component and a static resistive load component;

a display;

at least one sensor configured to monitor a pedal velocity of the pedals multiple times during a single revolution of the pedals, the at least one sensor being further configured to output a sensor signal indicative of a magnitude of a change in the pedal velocity between two of said multiple times during the single revolution of the pedals, the dynamic resistive load component of the applied resistance corresponding to the sensor signal;

a user input device configured to supply a resistance level selection of a user representing a selected bicycle gear, the static resistive load component of the applied resistance corresponding to the resistance level selection and being independent of the pedal velocity of the pedals; and a processor configured to receive the resistance level selection and the sensor signal and to output one or more control signals causing the electronically controlled resistance device to apply more or less resistance based at least upon the resistance level selection and the magnitude of the change in the pedal velocity between two of said multiple times during the single revolution of the pedals.

2. The stationary bicycle of claim 1, wherein the at least one sensor is configured to monitor the angular velocity of the flywheel.

3. The stationary bicycle of claim 1, wherein the dynamic resistive load component of the applied resistance proportionally corresponds to the magnitude of the change in the pedal velocity.

4. A stationary bicycle capable of approximately simulating a pedal resistance felt by a rider of a road-going bicycle, the stationary bicycle comprising:

a flywheel;

a rotatable crank connected to the flywheel, wherein rotation of the crank translates into rotation of the flywheel;

pedals rotatably attached to the crank;

an electronically controlled resistance device configured to interact with the flywheel to apply a resistance to the flywheel, wherein the resistance is translated back to the pedals causing a user to exercise;

a user input device configured to supply a resistance level selection of a user, the resistance level selection representing a selected bicycle gear;

a sensor configured to output a first signal indicative of a first pedal velocity during a first time of a first revolution of the pedals and a second signal indicative of a second pedal velocity during a second time of the first revolution of the pedals; and a processor configured to receive the first signal, the second signal, and the resistance level selection and to output one or more control signals causing the electronically controlled resistance device to apply more or less resistance based at least upon changes in the pedal velocity between the first and second times.

5. The stationary bicycle of claim 4, wherein the processor is configured to output the one or more control signals causing the electronically controlled resistance device to apply additional resistance proportional to a magnitude of an increase in the pedal velocity.

6. The stationary bicycle of claim 4, wherein the processor is configured to output the one or more control signals causing the electronically controlled resistance device to apply less resistance proportional to a magnitude of a decrease in the pedal velocity.

7. The stationary bicycle of claim 4, wherein the processor is configured to output the one or more control signals causing the electronically controlled resistance device to apply resistance accounting for a simulated linear momentum of the stationary bicycle.

8. The stationary bicycle of claim 7, wherein the simulated linear momentum accounts for an inputted mass of the user.

9. The stationary bicycle of claim 7, wherein the simulated linear momentum accounts for the selected bicycle gear.

10. The stationary bicycle of claim 4, wherein the processor is configured to output the one or more control signals causing the electronically controlled resistance device to apply resistance accounting for one or more simulated parasitic forces of the stationary bicycle.

11. The stationary bicycle of claim 4, further comprising at least one controller board configured to receive the one or more control signals from the processor and configured to output one or more signals that cause the electronically controlled resistance device to apply more or less resistance to the flywheel.

12. A stationary bicycle capable of approximating a pedal resistance felt by a rider of a road-going bicycle, the stationary bicycle comprising:

means for receiving a user-applied force during the performance of a cycling exercise, wherein said means for receiving is configured to operate at a rotational velocity during said cycling exercise;

means for applying a resistive load that is translated to said means for receiving;

means for sensing said rotational velocity of said means for receiving multiple times during a single rotation of said means for receiving, wherein said means for sensing is configured to output a first signal indicative of said rotational velocity at a first time of said multiple times and a second signal indicative of said rotational velocity at a second time of said multiple times;

means for receiving from a user a selected gear and for supplying a third signal representing the selected gear; and means for processing said first, second and third signals and for outputting one or more control signals causing said means for applying a resistive load to increase or decrease the resistive load based at least on said third signal and an increase or decrease in said rotational velocity between said first and second times.

13. The stationary bicycle of claim 1, wherein the resistance applied to the flywheel is calculated according to the formula $R=L+K(\partial V/\partial t)$, wherein R is the resistance applied to the flywheel, L is the static resistive load component, K is the resistance level selection and $\partial V/\partial t$ is the change in the pedal velocity over a period of time.

14. The stationary bicycle of claim 1, wherein the dynamic resistive load component is zero when the pedal velocity of the pedals remains constant.

15. The stationary bicycle of claim 1, wherein said multiple times correspond to approximately a one degree revolution of the pedals.

16. The stationary bicycle of claim 4, wherein the applied resistive load comprises a static resistive load component and a dynamic resistive load component.

17. The stationary bicycle of claim 16, wherein the static resistive load component is indicative of the resistance level selection.

18. The stationary bicycle of claim 16, wherein the dynamic resistive load component is zero when the pedal velocity of the pedals remains constant.

* * * * *

UNITED STATES PATENT AND TRADEMARK OFFICE

CERTIFICATE OF CORRECTION

PATENT NO. : 7,648,446 B2
APPLICATION NO. : 11/148008
DATED : January 19, 2010
INVENTOR(S) : Chiles et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1260 days.

Signed and Sealed this

Twenty-eighth Day of December, 2010

David J. Kappos

David J. Kappos
*Director of the United States Patent and Trademark Office*